US008888662B1

(12) United States Patent
Gomez, Jr.

(10) Patent No.: US 8,888,662 B1
(45) Date of Patent: Nov. 18, 2014

(54) ARTIFICIAL LIMB FOR COMBAT TRAINING

(71) Applicant: Daniel Gomez, Jr., Round Rock, TX (US)

(72) Inventor: Daniel Gomez, Jr., Round Rock, TX (US)

( * ) Notice: Subject to any disclaimer, the term of this patent is extended or adjusted under 35 U.S.C. 154(b) by 314 days.

(21) Appl. No.: 13/628,291

(22) Filed: Sep. 27, 2012

Related U.S. Application Data

(60) Provisional application No. 61/643,435, filed on May 7, 2012.

(51) Int. Cl.
*A63B 21/00* (2006.01)

(52) U.S. Cl.
USPC ..... 482/83; 482/90; 482/121; 482/126

(58) Field of Classification Search
USPC ..... 482/83, 90, 121, 907, 126
See application file for complete search history.

(56) References Cited

U.S. PATENT DOCUMENTS

| | | | | |
|---|---|---|---|---|
| 2007/0142186 | A1* | 6/2007 | Macnab | 482/83 |
| 2007/0167297 | A1* | 7/2007 | Stevenson | 482/83 |
| 2008/0254950 | A1* | 10/2008 | Beliles | 482/83 |
| 2009/0088302 | A1* | 4/2009 | Brenner et al. | 482/87 |
| 2011/0028279 | A1* | 2/2011 | Chen | 482/83 |

* cited by examiner

*Primary Examiner* — Jerome w Donnelly
(74) *Attorney, Agent, or Firm* — Plager Schack LLP

(57) ABSTRACT

An artificial limb assists a user in combat training. The artificial limb comprises a first arm retainer mechanically coupled to a first upper arm and a first cord, where the first cord travels through a first hollow portion of the first upper arm. The first cord is immediately adjacent to a first lower arm and terminates at first end ball. The first arm retainer is mechanically coupled to a piece of equipment by an upper strap and a lower strap. When a user strikes the piece of equipment the first upper arm, first lower arm and first end ball flail in a manner that simulates an actual assailant.

6 Claims, 4 Drawing Sheets

ARTIFICIAL LIMB FOR COMBAT TRAINING

CROSS REFERENCE TO RELATED APPLICATIONS

This application claims priority to U.S. Provisional Patent Application 61/643,435 filed on May 7, 2012.

FIELD OF THE INVENTION

This invention relates to devices that can be used for self-defense training

BACKGROUND OF THE INVENTION

The stated goal of most combat training devices is to provide targets for a user to practice martial arts maneuvers. The prior art includes U.S. Pat. No. 7,862,485 issued to Luigi; U.S. Pat. No. 6,063,011 issued to Pelchat; and U.S. Pat. No. 5,800,319 issued to Choate.

Choate teaches a sparring device comprising a column attached to a belt where the belt is attached to two horizontal members. Choate allows for "supple movement" that resembles a single member of a spring, but lacks the flailing of the present invention. Luigi teaches a sparring partner comprising a column with two parallel members attached to boxing gloves. The flailing of the Luigi device is limited by the ability of the parallel members to rotate around the column. Pelchat teaches a column with a series of parallel and perpendicular members to resemble a body, however, the members do not flail like actual appendages, rather, they are simply useful as targets.

The present invention teaches away from the goals of the prior art by emphasizing the ability of the target to flail from blows in a manner that resembles an actual assailant.

BRIEF SUMMARY OF THE INVENTION

An artificial limb assists a user in combat training. The artificial limb comprises a first arm retainer mechanically coupled to a first upper arm and a first cord, where the first cord travels through a first hollow portion of the first upper arm. The first cord is immediately adjacent to a first lower arm and terminates at first end ball. The first arm retainer is mechanically coupled to a piece of equipment by an upper strap and a lower strap. When a user strikes the piece of equipment the first upper arm, first lower arm and first end ball flail in a manner that simulates an actual assailant.

BRIEF DESCRIPTION OF THE SEVERAL VIEWS OF THE DRAWINGS

Figure 1:
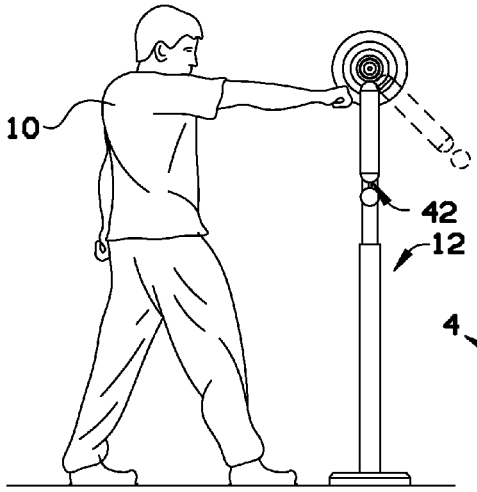

Having thus described the invention in general terms, reference will now be made to the accompanying drawings, which are not necessarily drawn to scale, and wherein:

FIG. 1 is a side view of the invention shown in use.

Figure 2:
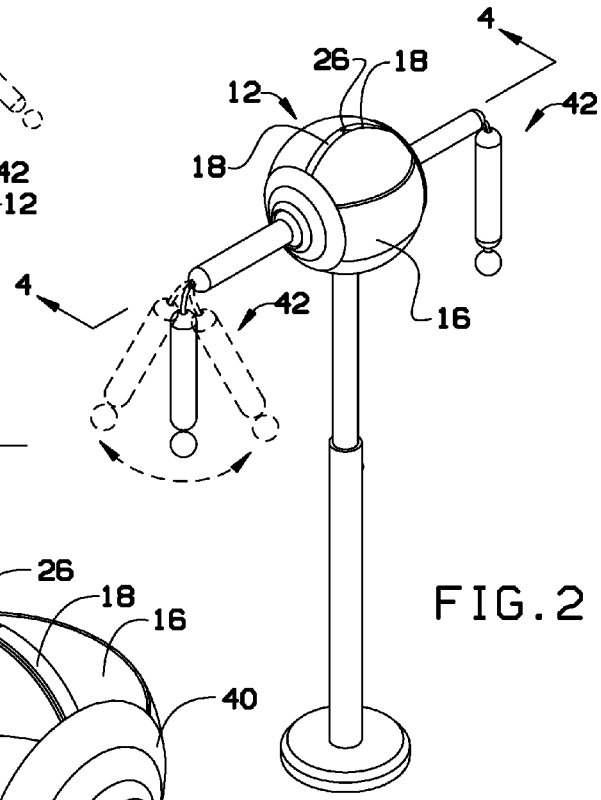

FIG. 2 is a rear perspective view of the invention shown in use.

Figure 3:
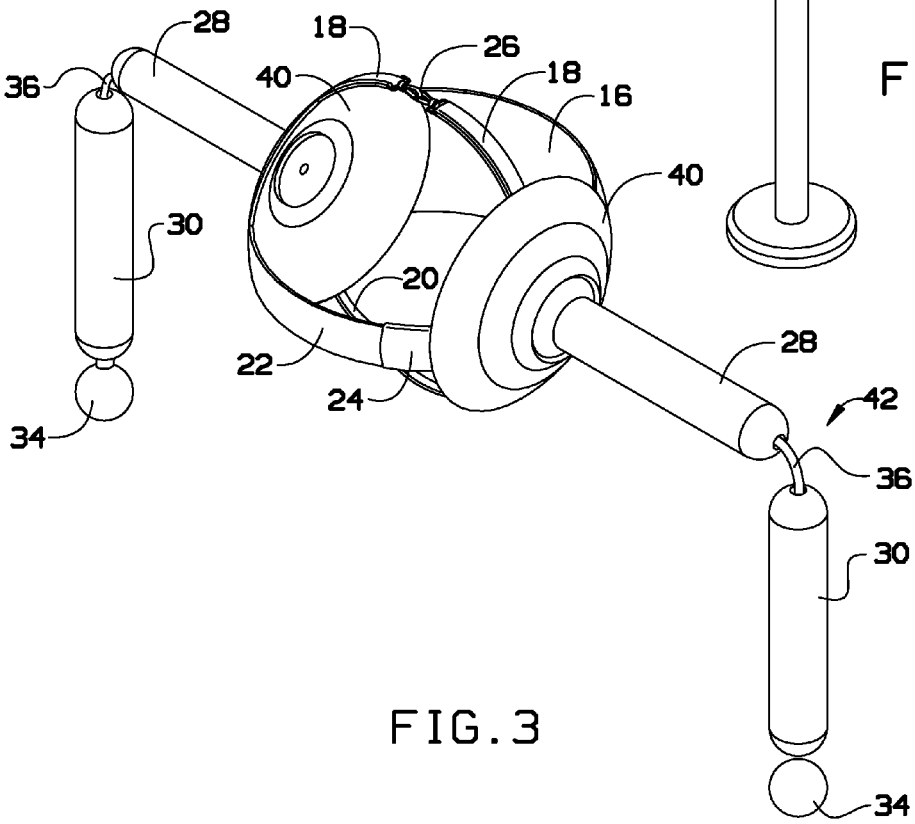

FIG. 3 is a forward perspective view of the invention.

Figure 4:
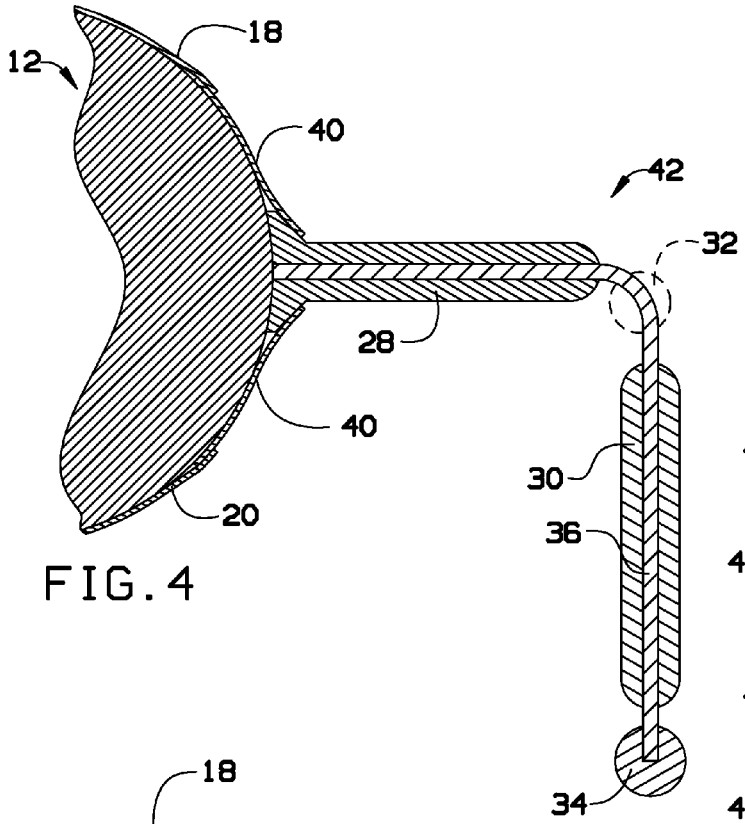

FIG. 4 is a section detail view of the invention along line 4-4 in FIG. 2.

Figure 5:
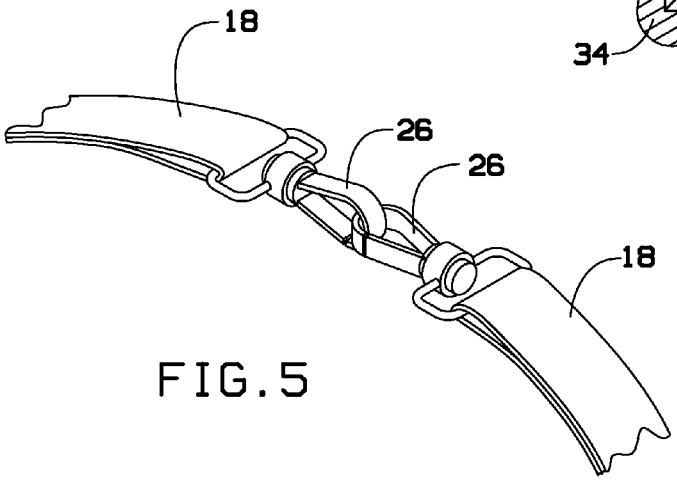

FIG. 5 is a detail perspective view of the invention.

Figure 6:
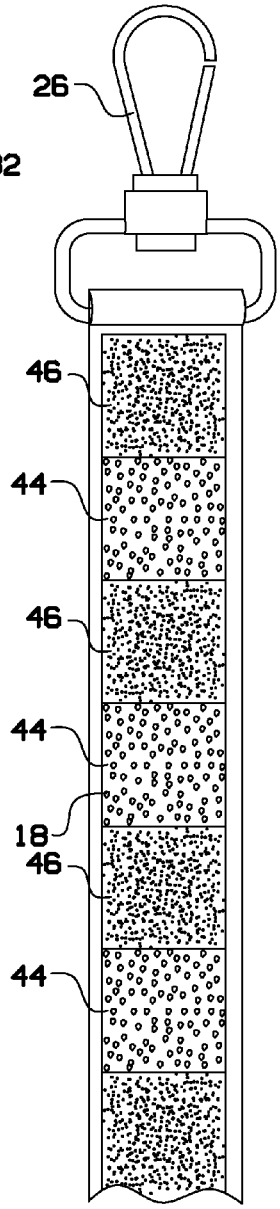

FIG. 6 is a detail front view of the invention.

Figure 7:
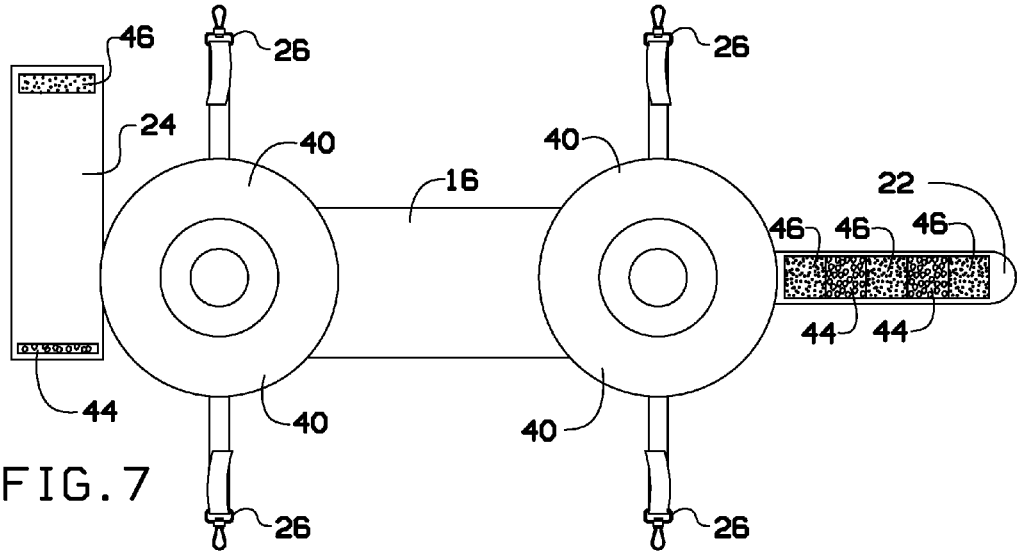

FIG. 7 is a front view of the invention.

Figure 8:
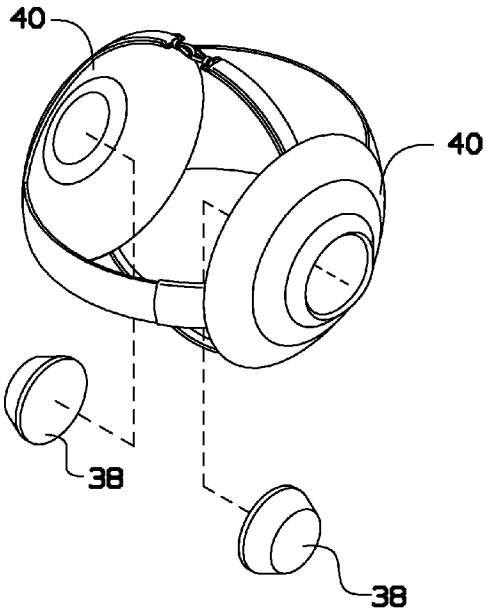

FIG. 8 is an exploded view of the invention illustrating an alternate assembly method.

Figure 9:
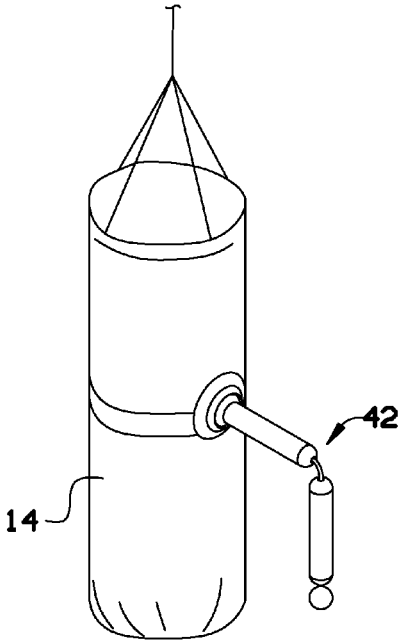

FIG. 9 is a perspective view of an alternate embodiment of the invention.

Figure 10:
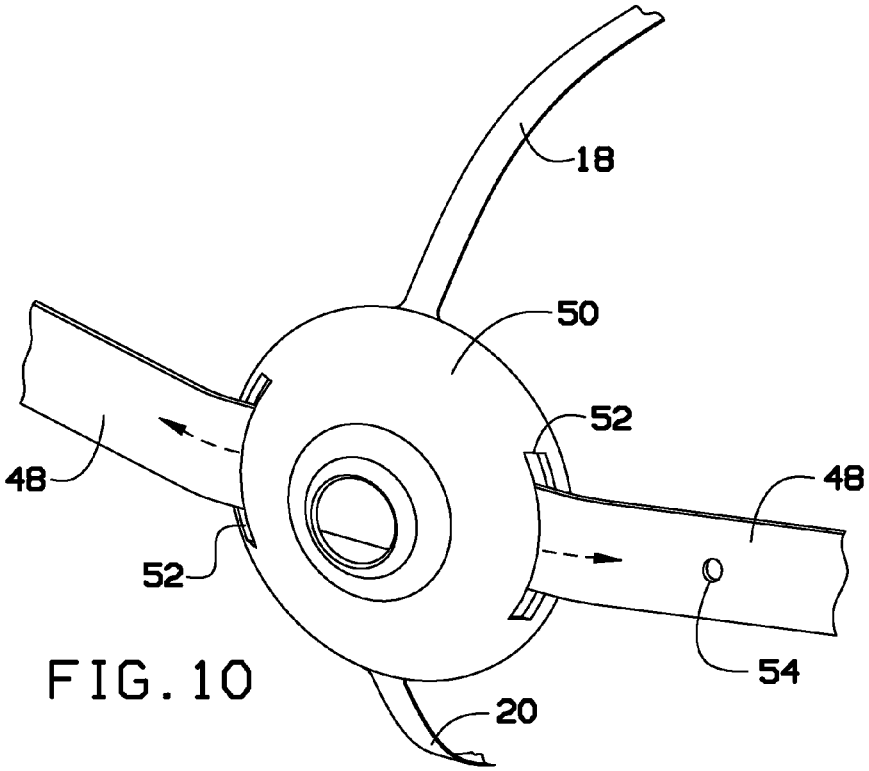

FIG. 10 is a front perspective view of an alternate embodiment of the invention.

Figure 11:
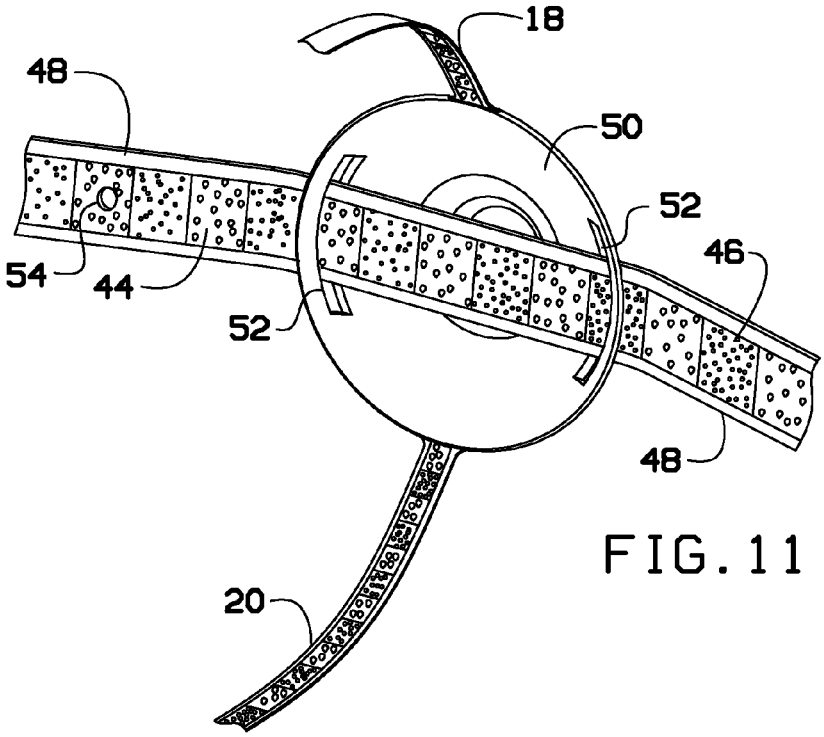

FIG. 11 is a rear perspective view of an alternate embodiment of the invention.

DETAILED DESCRIPTION OF THE INVENTION

Embodiments of the present invention overcome many of the obstacles associated with artificial limbs mimicking the flailing of actual limbs, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows the invention in use. User 10 desires to train for combat or in martial arts and desires to use artificial limb 42 which is mechanically coupled to ball stand 12. As a user strikes ball stand 12 artificial limb 42 moves as shown in FIG. 2.

FIG. 2 and Fig. shows the flailing of artificial limb 42 and artificial limb 42 in more detail. In the shown design there are two artificial limbs: first artificial limb 42 and second artificial limb 42. First artificial limb 42 comprises first upper arm 28 which is mechanically coupled to first arm retainer 40 and has a first hollow portion in order to accommodate first cord 36. First cord 36 is mechanically coupled to first arm retainer 40. First cord 36 is immediately adjacent to a second hollow portion in first lower arm 30 and terminates at first end ball 34.

First arm retainer 40 is mechanically coupled to second arm retainer 40 by forward strap 22, lower strap 20, upper strap 18 and rear strap 16. Upper strap 18 is shown in more detail in FIG. 5 and FIG. 6. Forward strap 22, lower strap 20, upper strap 18 and rear strap 16 are shown in more detail in FIG. 7.

Second artificial limb 42 comprises second upper arm 28 which is mechanically coupled to second arm retainer 40 and is hollow in order to accommodate second cord 36. Second cord 36 is mechanically coupled to second arm retainer 40. Second cord 36 is immediately adjacent to second lower arm 30 and terminates at second end ball 34.

FIG. 4 shows a section view of artificial limb 42. As noted above, artificial limb 42 comprises upper arm 28 mechanically coupled to arm retainer 40. Upper arm 28 is mechanically coupled and hollow to receive cord 36. Cord 36 is immediately adjacent to lower arm 30 and terminates at end ball 34. In some embodiments, cord 36 can be a rope or a bungee cord. Upper arm 28, lower arm 30 and end ball 34 can be made of foam. Upper arm 28, lower arm 30 and end ball 34 should have a similar diameter. Arm retainer 40 can similarly be made of leather straps.

FIG. 5 and FIG. 6 show various views of upper strap 18. Upper strap 18 has a first end mechanically coupled to a first clip 26 and a second end mechanically coupled to a second clip 26. Upper strap 18 further comprises alternating sections of male fastener 44 and female fastener 46. Male fastener 44 and female fastener 46 enable user 10 to affix upper strap 18 to forward strap 22 and forward strap securement sub strap 24 as shown in FIG. 7.

FIG. 7 shows the straps of the invention in more detail. First arm retainer 40 is mechanically coupled to the first end of first upper strap 18 and the second end of first upper strap 18. First arm retainer 40 is further mechanically coupled to rear strap 16. Rear strap 16 is further mechanically coupled to forward strap 22. Forward strap 22 can be further constrained by forward strap securement sub strap 24. Much like forward strap 22, forward strap securement sub strap 24 is mechanically coupled to female fastener 44 and male fastener 46.

FIG. 8 shows another example of arm retainer 40, instead of being affixed to upper arm 28 as in FIG. 2 and FIG. 3, arm retainer 40 is filled with plug 38. This allows a user to affix upper arm 28 to only one arm retainer 28 as shown in FIG. 9.

FIG. 9 shows how artificial limb 42 can be mechanically coupled to heavy bag 14.

FIG. 10 and FIG. 11 show an alternate manner of arranging the invention. Alternate arm retainer 50 comprises left belt slot 52 and right belt slot 52. Main belt 48 can be slid through left belt slot 52 and right belt slot 52. Main belt 48 further comprises inflation hole 54, which can be used to inflate whatever main belt 48 is wrapped around. Alternate arm retainer 50 is mechanically coupled to upper strap 18 and lower strap 20. Main belt is mechanically coupled to male fastener 46 and female fastener 48 which can be used to affix alternate arm retainer 50 to a piece of equipment such as headache bag also known as a double ended bag.

That which is claimed:

1. An artificial limb for combat training, the artificial limb comprising, a first arm retainer mechanically coupled to a first upper arm and a first cord, where the first cord travels through a first hollow portion of the first upper arm; the first cord is immediately adjacent to a first lower arm and terminates at first end ball;

the first arm retainer is mechanically coupled to a piece of equipment by an upper strap and a lower strap;

such that when a user strikes the piece of equipment the first upper arm, the first lower arm and the first end ball flail in a manner that simulates an actual assailant.

2. The artificial limb of claim 1, further comprising a second arm retainer is mechanically coupled to the piece of equipment by the upper strap and the lower strap;

the second arm retainer mechanically coupled to a second upper arm and a second cord, where the second cord travels through a second hollow portion of the second upper arm; the second cord is immediately adjacent to a second lower arm and terminates at second end ball;

such that when the user strikes the piece of equipment the first upper arm, the first lower arm and the first end ball, along with the second upper arm, the second lower arm and the second end ball flail in a manner that more closely simulates the actual assailant.

3. The artificial limb of claim 1, further comprising a second arm retainer is mechanically coupled to the piece of equipment by the upper strap, the lower strap, a forward strap, a rear strap and a forward strap securement sub strap in a manner that more completely secures the first arm retainer and the second arm retainer to the piece of equipment.

4. The artificial limb of claim 1, further comprising a second arm retainer is mechanically coupled to the piece of equipment by the upper strap, the lower strap, a forward strap, a rear strap and a forward strap securement sub strap in a manner that more completely secures the first arm retainer and the second arm retainer to the piece of equipment;

and the piece of equipment is a heavy bag.

5. The artificial limb of claim 1, further comprising a second arm retainer is mechanically coupled to the piece of equipment by the upper strap, the lower strap, a forward strap, a rear strap and a forward strap securement sub strap in a manner that more completely secures the first arm retainer and the second arm retainer to the piece of equipment;

and the piece of equipment is a ball stand.

6. The artificial limb of claim 1, further comprising the first arm retainer is an alternate arm retainer further comprising a left belt slot and a right belt slot;

a belt is immediately adjacent to the right belt slot and the left belt slot and can affix the alternate arm retainer to the piece of equipment.

* * * * *